US011735866B2

(12) United States Patent
Sun

(10) Patent No.: US 11,735,866 B2
(45) Date of Patent: Aug. 22, 2023

(54) CONNECTOR AND ELECTRICAL CONNECTION DEVICE

(71) Applicant: Molex, LLC, Lisle, IL (US)

(72) Inventor: Wei-Che Sun, New Taipei (TW)

(73) Assignee: Molex, LLC, Lisle, IL (US)

( * ) Notice: Subject to any disclaimer, the term of this patent is extended or adjusted under 35 U.S.C. 154(b) by 99 days.

(21) Appl. No.: 17/376,200

(22) Filed: Jul. 15, 2021

(65) Prior Publication Data

US 2022/0021157 A1 Jan. 20, 2022

(30) Foreign Application Priority Data

Jul. 15, 2020 (CN) ..... 202021395913.5

(51) Int. Cl.

| | |
|---|---|
| ***H01R 13/645*** | (2006.01) |
| ***H01R 13/631*** | (2006.01) |
| ***H01R 13/66*** | (2006.01) |
| ***H01R 13/627*** | (2006.01) |

(52) U.S. Cl.

CPC ..... *H01R 13/645* (2013.01); *H01R 13/6273* (2013.01); *H01R 13/631* (2013.01); *H01R 13/665* (2013.01)

(58) Field of Classification Search

CPC ..... H01R 13/645; H01R 13/6273; H01R 13/631; H01R 13/665; H01R 13/6658

See application file for complete search history.

(56) References Cited

U.S. PATENT DOCUMENTS

| | | | | |
|---|---|---|---|---|
| 9,300,088 | B2 | 3/2016 | Tseng | |
| 11,233,359 | B2 * | 1/2022 | Wang | H01R 13/502 |
| 2021/0265782 | A1 * | 8/2021 | Wang | H01R 12/62 |
| 2022/0021157 | A1 * | 1/2022 | Sun | H01R 13/6273 |

FOREIGN PATENT DOCUMENTS

CN 109713480 A 5/2019

* cited by examiner

*Primary Examiner* — Abdullah A Riyami
*Assistant Examiner* — Nader J Alhawamdeh

(57) ABSTRACT

A connector includes an insulative housing and a circuit board. The insulative housing comprises a housing body, an insertion plate, two side walls and a stopping wall. The housing body has a front end surface, the insertion plate is positioned at a top side of the housing body and protrudes from the front end surface, the two side walls are respectively positioned at a left side and a right side of the housing body and protrudes from the front end surface. The housing body, the insertion plate and the two side walls together form a receiving space. The stopping wall is positioned at a side of the insulating housing opposite to the insertion plate and has a stopping end positioned in front of the front end surface. The circuit board is provided to the housing body and partially protrudes into the receiving space. The stopping end of the stopping wall is stopped by the mating connector, it can prevent the user from improperly inserting the connector in an upside down orientation into the mating connector.

20 Claims, 13 Drawing Sheets

CONNECTOR AND ELECTRICAL CONNECTION DEVICE

RELATED APPLICATIONS

The present application claims priority to Chinese Patent Application No. 202021395913.5 filed Jul. 15, 2020, which is incorporated herein by reference in its entirety.

TECHNICAL FIELD

The present disclosure relates to a connector, and more particularly relates to a connector and an electrical connection device which are capable of preventing improperly insertion.

BACKGROUND ART

Chinese patent application publication No. CN109713480A discloses an electrical connector assembly which includes an electrical connector and a mating connector. In a state that the electrical connector is properly inserted, the electrical connector is mated with the mating connector, and two limiting portions are respectively latched to two locking holes so that the electrical connector can be positioned to the mating connector and electrically connected with the mating connector to transmit a signal.

When the electrical connector is subjected to an external force in an up-down direction during the process of inserting or pulling out or after mated with the mating connector, because a bottom of the mating connector is completely exposed without being limited in position and supported by the electrical connector, a reaction force applied to the electrical connector by the mating connector will all concentrated on a cooperating plate and two guiding portions, so that the electrical connector is prone to shake and an amplitude of the shaking is large. Therefore, the mating state of the electrical connector after mated is relatively unstable.

In addition, because there is no a mechanism and a structure to prevent the electrical connector from improperly insertion, after the electrical connector is rotated by 180 degrees, the electrical connector can still be mated with the mating connector, which makes the user easy to insert the electrical connector improperly.

SUMMARY

Therefore, one of objects of the present disclosure is to provide a connector which can overcome at least one deficiency of the prior art.

Therefore, in some embodiments, the connector of the present disclosure includes an insulative housing and a circuit board. The insulative housing comprises a housing body, an insertion plate, two side walls and at least one stopping wall. The housing body has a front end surface, the insertion plate is positioned at a top side of the housing body and protrudes from the front end surface, the two side walls are respectively positioned at a left side and a right side of the housing body and protrudes from the front end surface. The housing body, the insertion plate and the two side walls together form a receiving space. The stopping wall is positioned at a side of the insulating housing opposite to the insertion plate, the stopping wall has a stopping end positioned in front of the front end surface. The circuit board is provided to the housing body and partially protrudes into the receiving space.

In some embodiments, the stopping wall defines a limiting groove which is communicated with the receiving space, and the limiting groove has an opening toward forwardly.

In some embodiments, the stopping wall protrudes from at least one of the housing body and the corresponding side wall.

In some embodiments, the stopping wall has a stopping wall portion which is connected with at least one of the housing body and one of the two side walls, and the stopping wall portion has the stopping end.

In some embodiments, the stopping wall further has an end wall portion which protrudes from a bottom of the housing body, and the stopping wall portion protrudes from the end wall portion and is connected with the housing body via the end wall portion.

In some embodiments, the stopping wall further has at least one side wall portion which protrudes from a bottom end of the corresponding side wall, and the stopping wall portion is connected to the corresponding side wall portion and connected with the housing body via the corresponding side wall portion.

In some embodiments, the stopping wall further has at least one side wall portion which protrudes from the bottom end of the corresponding side wall, and the side wall portion is connected to a same side of the end wall portion and the stopping wall portion.

In some embodiments, the insulative housing comprises the two stopping walls which are spaced apart from each other in a left-right direction.

In some embodiments, the stopping wall has two side wall portions which respectively protrude from the bottom ends of the two side walls, and the two side wall portions are respectively connected to a left side and a right side of the stopping wall portion.

In some embodiments, the stopping wall further has two side wall portions which respectively protrude from bottom ends of the two side walls, and the two side wall portions are respectively connected to a left side and a right side of the end wall portion and are respectively connected to a left side and a right side of the stopping wall portion.

In some embodiments, the connector further comprises a locking member which is provided to the insulative housing, the locking member comprises a locking segment and a pressing plate extending upwardly from the locking segment.

One of objects of the present disclosure is to provide an electrical connection device which can overcome at least one deficiency of the prior art.

Therefore, in some embodiments, the electrical connection device of the present disclosure includes a mating connector and a connector. The mating connector comprises an insulative base, a plurality of terminals and a metal shell. The insulative base is formed with a mating slot. The plurality of terminals are provide to the insulative base. The metal shell sheathes the insulative base and surrounds the insulative base, the metal shell comprises a top plate, and the top plate and the insulative base together define an insertion groove. The connector comprises an insulative housing and a circuit board. The insulative housing comprises a housing body, an insertion plate, two side walls and at least one stopping wall. The housing body has a front end surface, the insertion plate is positioned at a top side of the housing body, protrudes from the front end surface and is used to insert into the insertion groove, the two side walls are respectively positioned at a left side and a right side of the housing body and protrude from the front end surface, the housing body, the insertion plate and the two side walls together form a receiving space which is used to allow the mating connector to insert. The stopping wall is positioned at a side of the insulative housing opposite to the insertion plate, the stopping wall has a stopping end which is positioned in front of the front end surface and is used to be stopped by an end edge of the top plate. The circuit board is provided to the housing body, partially protrudes into the receiving space and is used to mate with the mating slot. When the connector is properly inserted, the insertion plate and the circuit board is capable of being inserted into the insertion groove and the mating slot of the mating connector respectively, so that the connector is mated with the mating connector; when the connector is improperly inserted in an upside down orientation, the stopping wall is stopped by the end edge of the top plate to prevent the connector from being mated with the mating connector.

In some embodiments, the top plate has two side portions which are spaced apart from each other in a left-right direction, and when the connector is improperly inserted in the upside down orientation, the stopping end of the stopping wall is at least stopped by the side end edge of corresponding one of the two side portions.

In some embodiments, the insulative housing comprises two stopping walls which are spaced apart from each other in the left-right direction, and the stopping end of each stopping wall is used to be stopped by the end edge of the corresponding side portion.

In some embodiments, the stopping end of the stopping wall is used to be stopped by the end edges of the two side portions at the same time.

In some embodiments, the metal shell further comprises a bottom plate opposite to the top plate, the stopping wall defines a limiting groove which is communicated with the receiving space and is used to receive the bottom plate, the limiting groove has an opening toward forwardly, and when the connector is properly inserted, the bottom plate is inserted into and received in the limiting groove via the opening.

In some embodiments, the metal shell further comprises a bottom plate opposite to the top plate, the stopping wall protrudes from at least one of the housing body and the corresponding side wall and has an inner stopping surface, when the connector is properly inserted, the inner stopping surface of the stopping wall stops a bottom end of the bottom plate.

In some embodiments, the stopping wall has a stopping wall portion which is connected with at least one of the housing body and one of the two side walls, and the stopping wall portion has the stopping end.

In some embodiments, the stopping wall further has an end wall portion which protrudes from a bottom of the housing body, and the stopping wall portion protrudes from the end wall portion and is connected with the housing body via the end wall portion.

In some embodiments, the stopping wall further has at least one side wall portion which protrudes from a bottom end of the corresponding side wall, and the stopping wall portion is connected to the corresponding side wall portion and connected with the housing body via the corresponding side wall portion.

In some embodiments, the stopping wall further has at least one side wall portion which protrudes from the bottom end of the corresponding side wall, and the side wall portion is connected to a same side of the end wall portion and the stopping wall portion.

In some embodiments, the insulative housing comprises the two stopping walls which are spaced apart from each other in a left-right direction.

In some embodiments, the stopping wall has two side wall portions which respectively protrude from the bottom ends of the two side walls, and the two side wall portions are respectively connected to a left side and a right side of the stopping wall portion.

In some embodiments, the stopping wall further has two side wall portions which respectively protrude from bottom ends of the two side walls, and the two side wall portions are respectively connected to a left side and a right side of the end wall portion and are respectively connected to a left side and a right side of the stopping wall portion.

In some embodiments, the connector further comprises a locking member which is provided to the insulative housing, the locking member comprises a locking segment which can be unlocked and locked to the metal shell and a pressing plate which extends upwardly from the locking segment, when the connector is properly inserted, the locking segment is locked to the metal shell.

In some embodiments, a guiding groove is formed between each side wall and the insertion plate and is used to allow the corresponding side portion to insert, when the connector is properly inserted, each side portion is inserted into the corresponding guiding groove.

The disclosure has at least the following technical effects: the stopping wall portion of the stopping wall is stopped by the end edge of the top plate of the metal shell, it can prevent the user from improperly inserting the connector in an upside down orientation into the mating connector. In addition, after the connector is properly inserted and mated with the mating connector, the bottom plate of the metal shell is received in the limiting groove and is stopped by the stopping wall portion of the stopping wall, the connector can be firmly mated with the mating connector.

BRIEF DESCRIPTION OF THE DRAWINGS

Other features and technical effects of the present disclosure will be apparent in embodiments referring to the accompanying figures, in which.

DETAILED DESCRIPTION OF THE PREFERRED EMBODIMENTS

Figure 1:
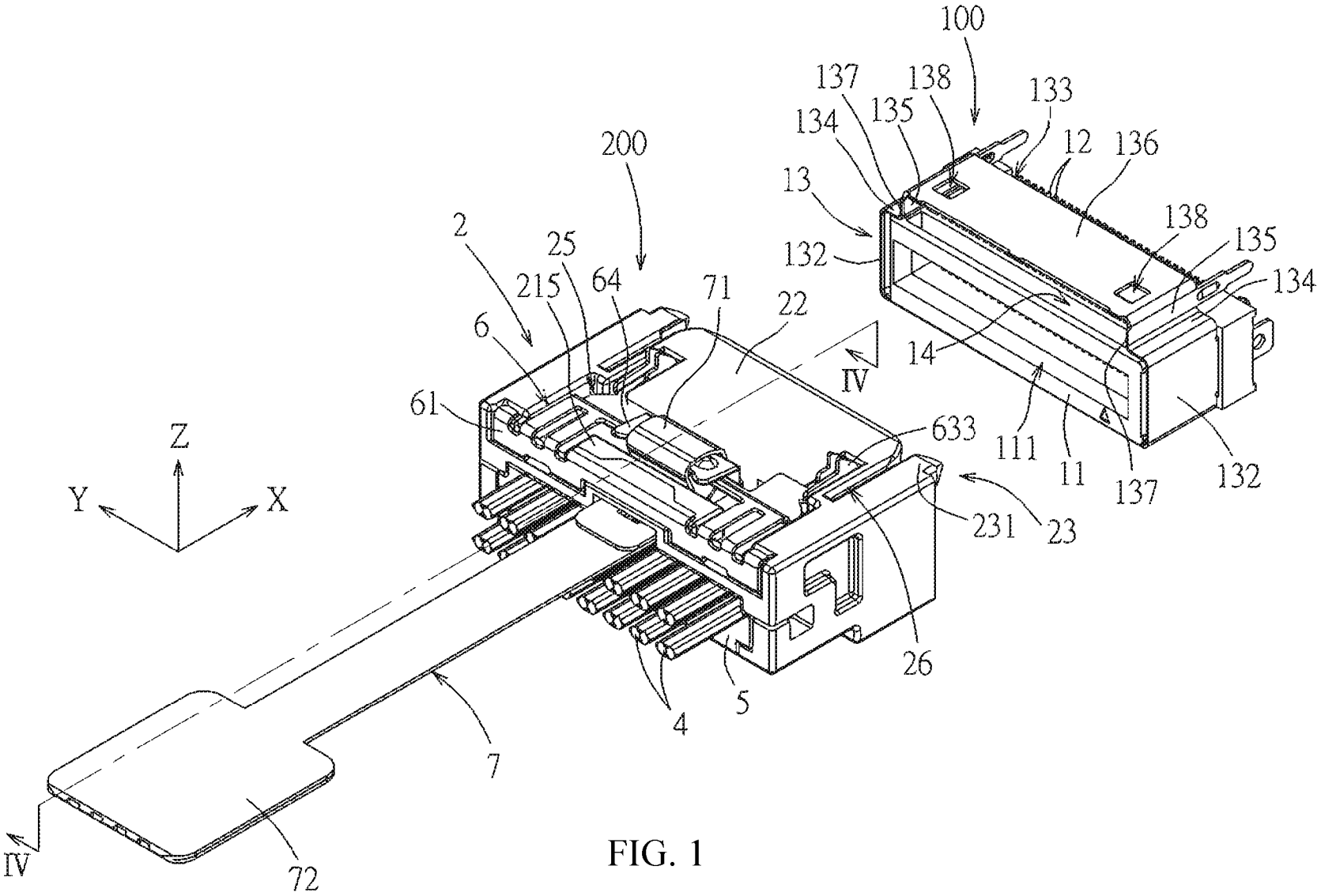
FIG. 1 is a perspective exploded view of a first embodiment of an electrical connection device of the present disclosure illustrating an assembling relationship between a connector and a mating connector.

Before the present disclosure is described in detail, it is noted that like elements are represented by the same reference numerals in the following description.

Figure 2:
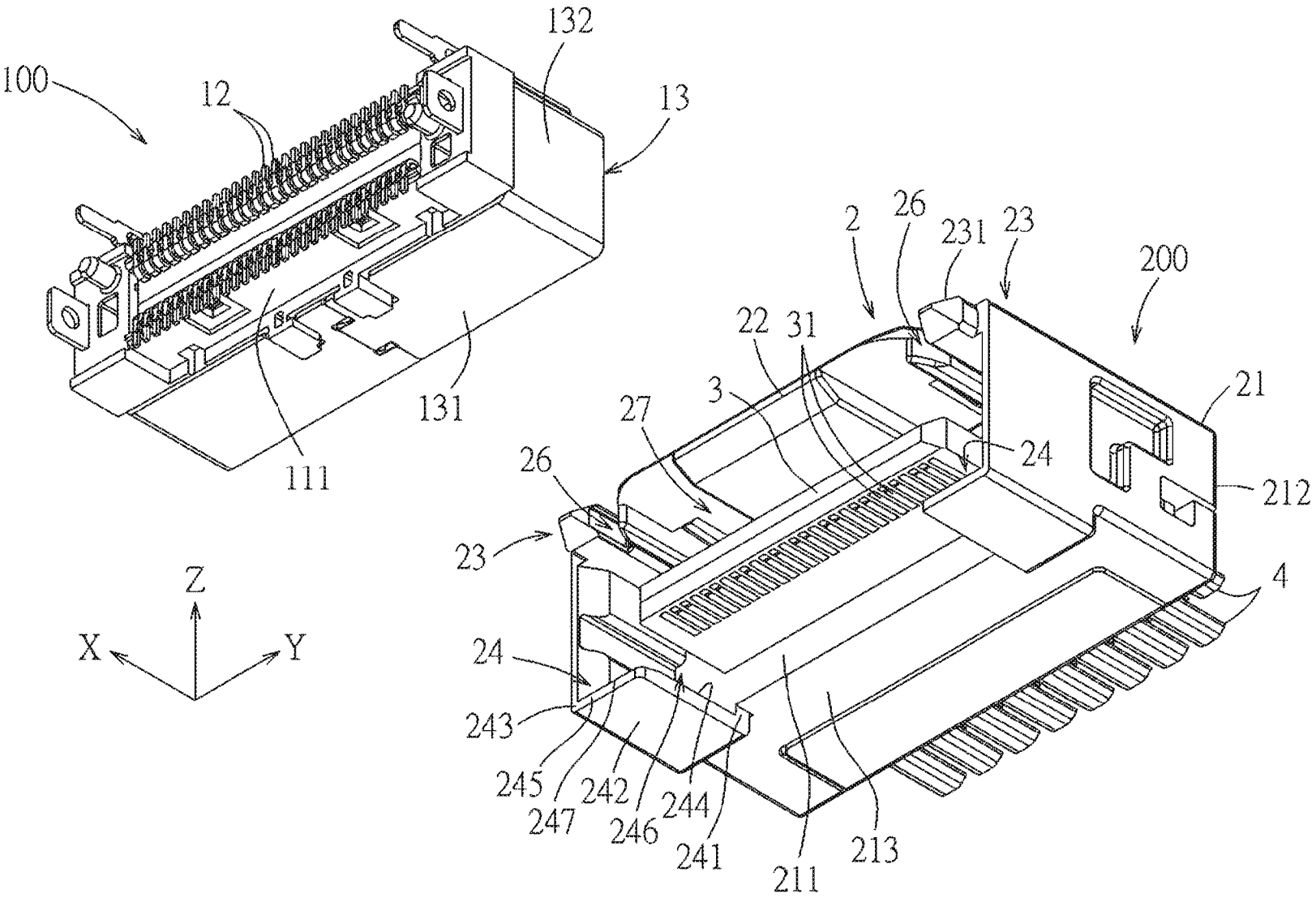
FIG. 2 is a perspective exploded view of the first embodiment viewed from another angle.

Referring to FIG. 1 and FIG. 2, a first embodiment of an electrical connection device of the present disclosure includes a mating connector 100 and a connector 200 which is used to mate with the mating connector 100. The connector 200 can be mated with the mating connector 100 along a front-rear direction X.

The mating connector 100 takes a receptacle connector as an example, and includes an insulative base 11, a plurality of terminals 12 and a metal shell 13. The insulative base 11 is formed with a mating slot 111 opened rearwardly. The plurality of terminals 12 are provided to the insulative base 11, and a part of each terminal 12 is positioned in the mating slot 111. The metal shell 13 sheathes the insulating base 11 and surrounds the insulating base 11, the metal shell 13 includes a bottom plate 131, two side plates 132 and a top plate 133. The bottom plate 131 abuts against a bottom surface of the insulative base 11. The two side plates 132 extend upwardly from a left side and a right side of the bottom plate 131 respectively and are spaced apart from each other along a left-right direction Y, the two side plates 132 abut against a left side and a right side of the insulating base 11 respectively. The top plate 133 has two connecting portions 134, two side portions 135 and a top portion 136. The two connecting portions 134 extend inwardly from top ends of the two side plates 132 respectively and abut against a top surface of the insulative base 11. The two side portions 135 extend upwardly from inner ends of the two connecting portions 134 respectively and are spaced apart from each other along the left-right direction Y. Each side portion 135 has an end edge 137 facing rearwardly. The top portion 136 is connected to top ends of the two side portions 135 and is spaced apart from the top surface of the insulative base 11 along an up-down direction Z. The two side portions 135, the top portion 136 and the top surface of the insulative base 11 together define an insertion groove 14 opened rearwardly. The top portion 136 is formed with two latching holes 138 which are spaced apart from each other along the left-right direction Y and are communicated with the insertion groove 14.

Referring to FIG. 1, FIG. 2, FIG. 3 and FIG. 4, the connector 200 takes a plug connector as an example, and includes an insulative housing 2, a circuit board 3, a plurality of cables 4, a covering block 5, a locking member 6 and a pull strap 7. The insulative housing 2 includes a housing body 21, an insertion plate 22, two side walls 23 and two stopping walls 24. The housing body 21 has a front end surface 211, a rear end surface 212 which is opposite to the front end surface 211 and a bottom surface 213 which is connected between a bottom end of the front end surface 211 and a bottom end of the rear end surface 212. The housing body 21 is formed with a positioning groove 214 which extends between the front end surface 211 and the rear end surface 212, and a part of the positioning groove 214 which is adjacent to the rear end surface 212 extends to the bottom surface 213. The insertion plate 22 is positioned at a top side of the housing body 21 and protrudes forwardly from the front end surface 211 along the front-rear direction X. The insertion plate 22 is used to insert into the insertion groove 14. The insertion plate 22 and the housing body 21 together define a positioning groove 25 which is used to receive the locking member 6, and the positioning groove 25 is positioned above the positioning groove 214. The two side walls 23 are respectively positioned at a left side and a right side of the housing body 21 and protrude forwardly from the front end surface 211 along the front-rear direction X, and the two side walls 23 are spaced apart from each other along the left-right direction Y. Each side wall 23 has a top portion 231. An inner side of the top portion 231 of each side wall 23 is spaced apart from a corresponding side edge of the insertion plate 22, and a guiding groove 26 is formed between the inner side of the top portion 231 of each side wall 23 and the corresponding side edge of the insertion plate 22. The guiding groove 26 has an elongated groove shape and a length direction of the elongated groove extends along the front-rear direction X, the guiding groove 26 is used to allow the corresponding side portion 135 to insert and guide moving direction of the corresponding side portion 135. The housing body 21, the insertion plate 22 and the two side walls 23 together form a receiving space 27 opened forwardly, the receiving space 27 is communicated with the positioning groove 214 and the two guiding grooves 26 and is used to allow the mating connector 100 to insert therein.

It is noted that, as an example, the insertion plate 22 and the two side walls 23 protrude from the front end surface 211 in the first embodiment, but the present disclosure is not limited thereto, the insertion plate 22 also may extend from an outer surface of the top side of the housing body 21, and the two side walls 23 also may extend from outer surfaces of the left side and the right side of the housing body 21 respectively.

Figure 4:
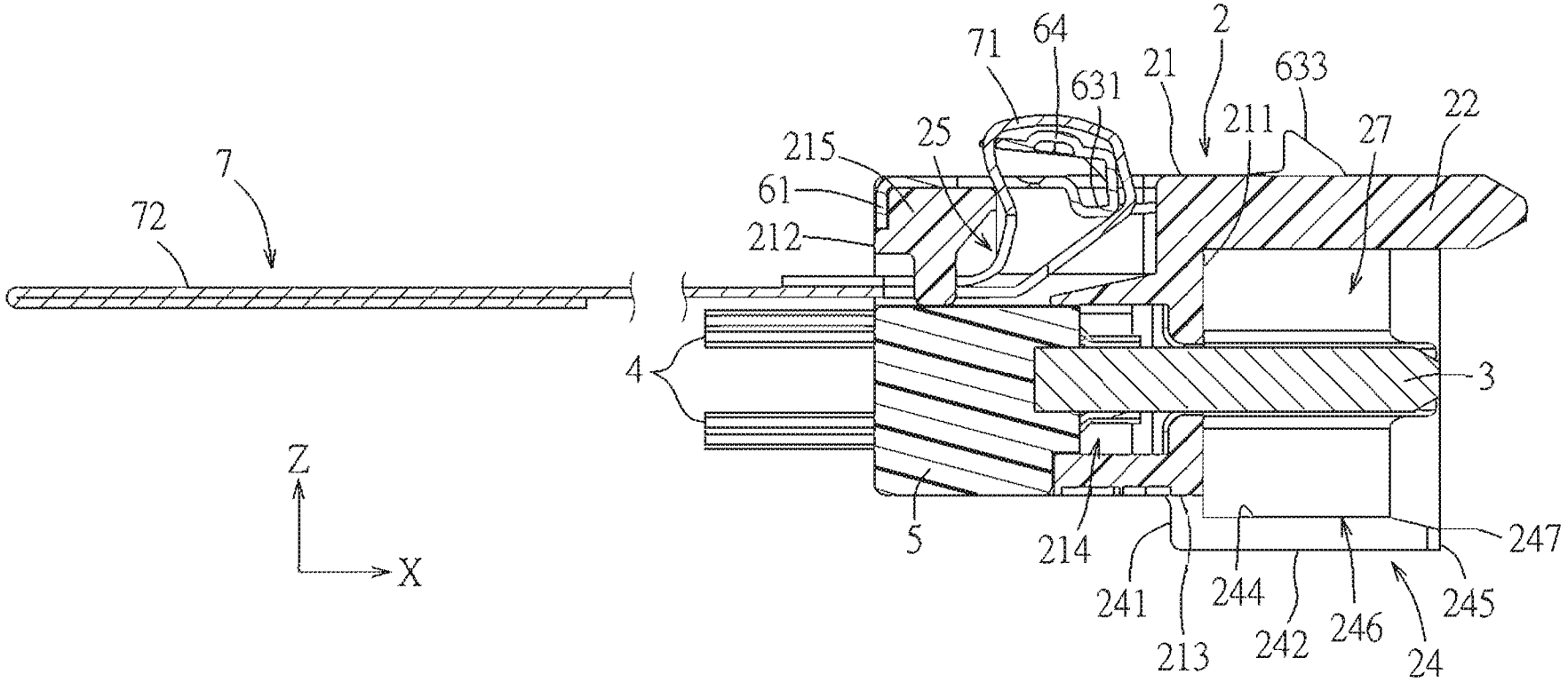
FIG. 4 is an incomplete cross-sectional view taken along a line IV-IV of FIG. 1 illustrating an assembling relationship between the locking member and a pull strap.
Figure 5:
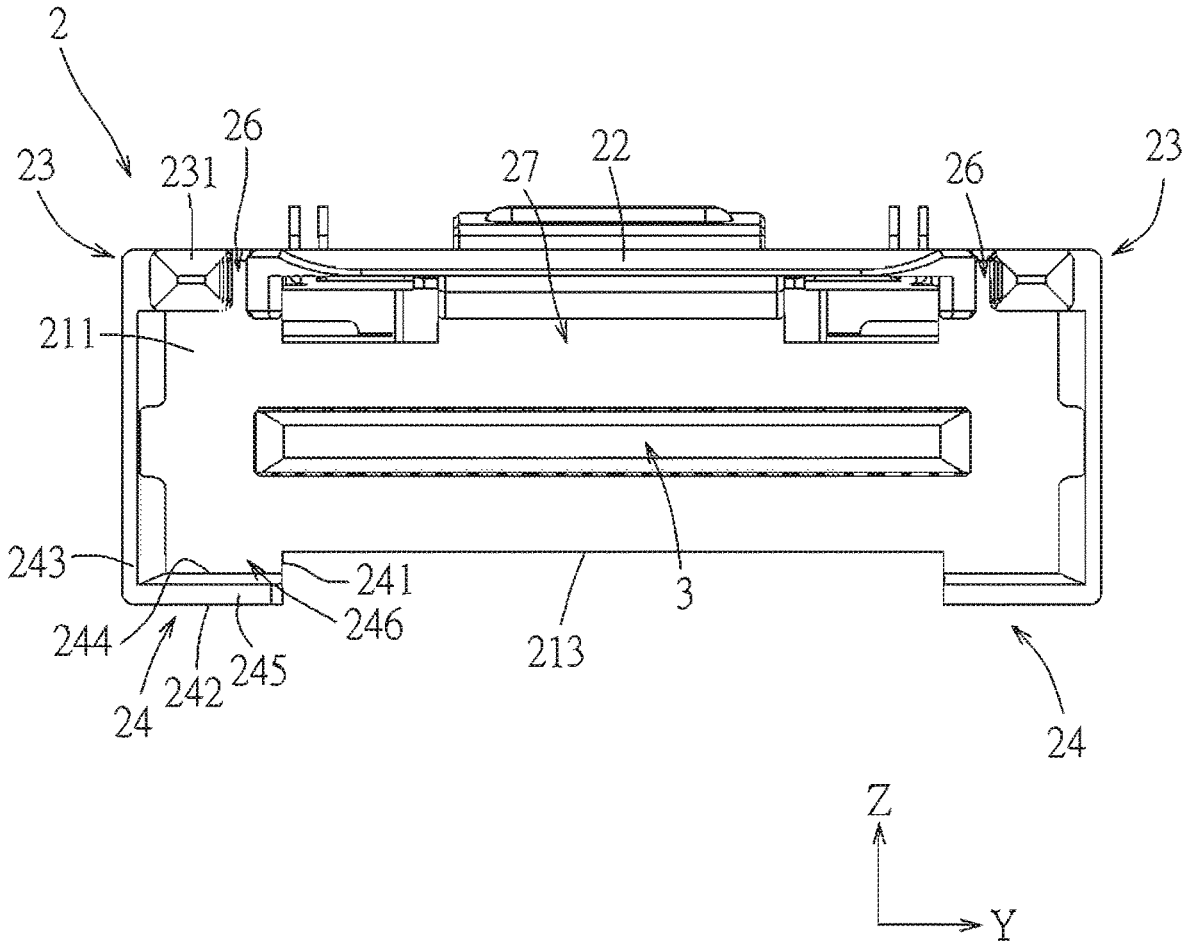
FIG. 5 is a front view of the connector of the first embodiment.

Referring to FIG. 2, FIG. 4 and FIG. 5, the two stopping walls 24 are positioned at a side of the insulative housing 2 opposite to the insertion plate 22, are spaced apart from each other along the left-right direction Y and protrude from the front end surface 211. In the first embodiment, each stopping wall 24 has an end wall portion 241, a stopping wall portion 242 and a side wall portion 243. The end wall portion 241 protrudes downwardly from the bottom surface 213 of the housing body 21, and a front end of the end wall portion 241 is flush with and coplanar with the front end surface 211. The stopping wall portion 242 protrudes forwardly from the front end of the end wall portion 241 along the front-rear direction X, and the stopping wall portion 242 protrudes from the front end surface 211. The stopping wall portion 242 has an inner stopping surface 244 which faces the receiving space 27 and a stopping end 245 which is positioned at a front end of the inner stopping surface 244. The inner stopping surface 244 is used to stop a bottom end of the bottom plate 131 of the metal shell 13. The stopping end 245 is used to stop the end edge 137 of the corresponding side portion 135 (as shown in FIG. 1). The side wall portion 243 protrudes downwardly from a bottom end of the corresponding side wall 23, and the side wall portion 243 is connected to a side of the end wall portion 241 and a side of the stopping wall portion 242. The end wall portion 241, the stopping wall portion 242 and the side wall portion 243 of each stopping wall 24 together define a limiting groove 246 which is communicated with the receiving space 27, the limiting groove 246 is used to receive the bottom plate 131. The limiting groove 246 has an opening 247 toward forwardly.

Figure 3:
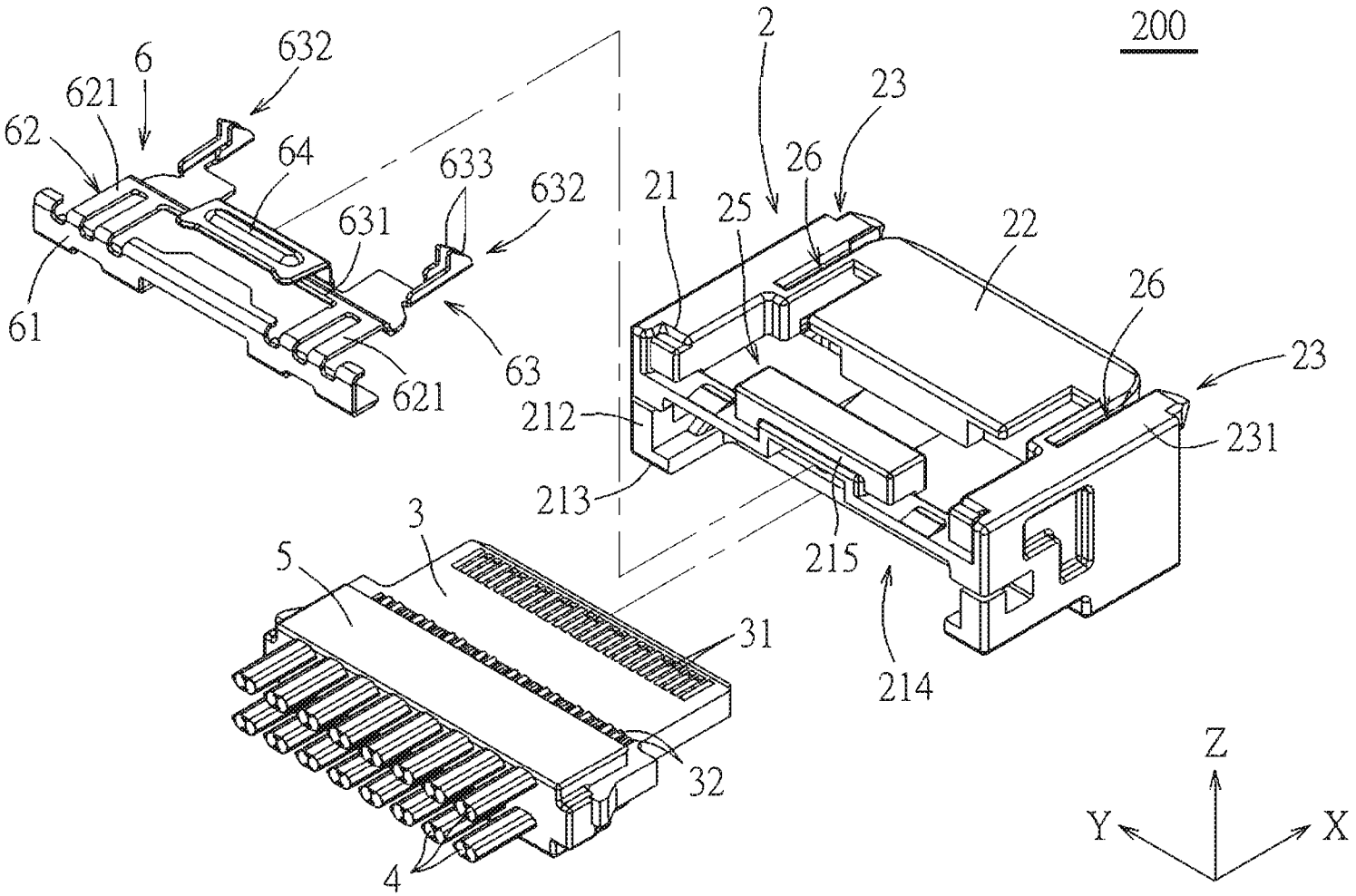
FIG. 3 is a perspective exploded view of the connector of the first embodiment illustrating an assembling relationship among an insulative housing, a circuit board, a plurality of cables, a covering block and a locking member.

Referring to FIG. 2, FIG. 3 and FIG. 4, an upper surface and a lower surface of the circuit board 3 each are provided with a plurality of contact pads 31 and a plurality of soldering pads 32. The contact pads 31 are adjacent to a front end of the circuit board 3, are arranged along the left-right direction Y, spaced apart from each other, and are used to respectively contact and electrically connect with the plurality of terminals 12. The soldering pads 32 are adjacent to a rear end of the circuit board 3, are arranged along the left-right direction Y and are spaced apart from each other. The plurality of cables 4 are respectively soldered to the soldering pads 32. The covering block 5 is integrally formed with the circuit board 3 and the plurality of cables 4 and covers a part of the circuit board 3 and a part of the plurality of cables 4. The circuit board 3 and the covering block 5 are mounted in the positioning groove 214, and a part of the circuit board 3 protrudes into the receiving space 27 and is used to mate with the mating slot 111 (as shown in FIG. 1).

Referring to FIG. 1, FIG. 3 and FIG. 4, the locking member 6 is mounted in the positioning groove 25 of the insulative housing 2. For example, the locking member 6 is made of a metal material. The locking member 6 includes a holding segment 61, an elastic segment 62, a locking segment 63 and a pressing plate 64. The holding segment 61 is held on a rear wall 215 of the housing body 21. The elastic segment 62 has two elastic arms 621 which extend forwardly from a top end of the holding segment 61 and are spaced apart from each other along the left-right direction Y. The locking segment 63 can be unlocked and locked to the metal shell 13 and has a connecting rod 631 which is connected to front ends of the two elastic arms 621 and two locking arms 632 which extend forwardly from a front end of the connecting rod 631 and are spaced apart from each other along the left-right direction Y. Each locking arm 632 has two latching hooks 633 protruding from a top end of the insertion plate 22, the two latching hooks 633 of each locking arm 632 can be detachably latched with the corresponding latching hole 138 of the metal shell 13. The pressing plate 64 extends upwardly from the front end of the connecting rod 631 and has an inverted L shape to allow to be pressed.

The pull strap 7 includes a sheathing segment 71 and a grasping segment 72. The sheathing segment 71 sheathes the pressing plate 64 and the connecting rod 631 of the locking member 6. The grasping segment 72 is connected to the sheathing segment 71, protrudes from a rear end of the insulative housing 2 and allows the user to grasp.

Referring to FIG. 6, FIG. 7, FIG. 8 and FIG. 9, when the connector 200 moves forwardly along the front-rear direction X and is properly inserted into the mating connector 100, the insertion plate 22 is first inserted into the insertion groove 14, and at the same time, each side portion 135 of the top plate 133 of the metal shell 13 is inserted into the corresponding guide groove 26. With the mutual cooperation between the aforementioned structures, the connector 200 can be guided to continue to move forwardly.

Subsequently, the circuit board 3 will be inserted into the mating slot 111, at the same time, the insulative base 11 of the mating connector 100 and the side plates 132 and the connecting portions 134 of the metal shell 13 are inserted into the receiving space 27, the bottom plate 131 of the metal shell 13 is inserted into the limiting groove 246 via the opening 247. Then, the two latching hooks 633 of each locking arm 632 will contact a rear end edge of the top portion 136 and be blocked by the rear end edge of the top portion 136, a component force applied to the two latching hooks 633 of each locking arm 632 by the top portion 136 will cause each elastic arm 621 to bend and deform downwardly relative to the holding segment 61 and accumulate an elastic restoring force. Therefore, the two latching hooks 633 of each locking arm 632 can move downwardly into the positioning groove 25 and abut against a bottom surface of the top portion 136 so as to move on the bottom surface of the top portion 136.

When the connector 200 moves to a position where the two latching hooks 633 of each locking arm 632 are separated from the bottom surface of the top portion 136 and are aligned with below the respective latching hole 138, each locking arm 632 is elastically moved upwardly by the elastic restoring force accumulated by the corresponding elastic arm 621, so that each locking arm 632 can automatically move to a locking position where the two latching hooks 633 are latched in the corresponding latching hole 138. At this time, the connector 200 is mated with the mating connector 100 and is positioned on the mating connector 100. The contact pads 31 (as shown in FIG. 3) of the circuit board 3 respectively contact the plurality of terminals 12 and are electrically connected with the plurality of terminals 12, so that the connector 200 and the mating connector 100 can transmit a signal.

Figure 6:
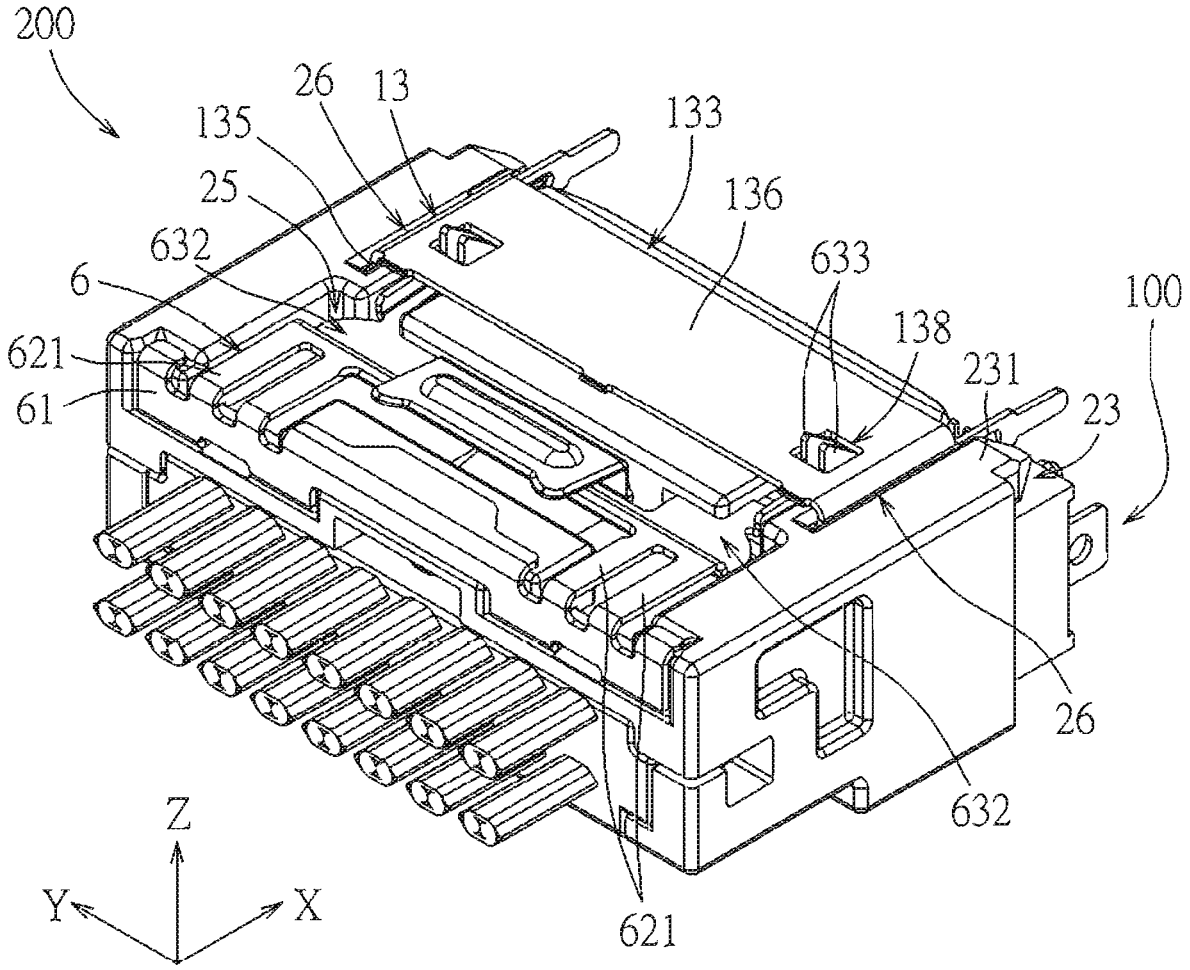
FIG. 6 is a perspective view of the first embodiment illustrating that the connector is properly inserted and mated with the mating connector.
Figure 7:
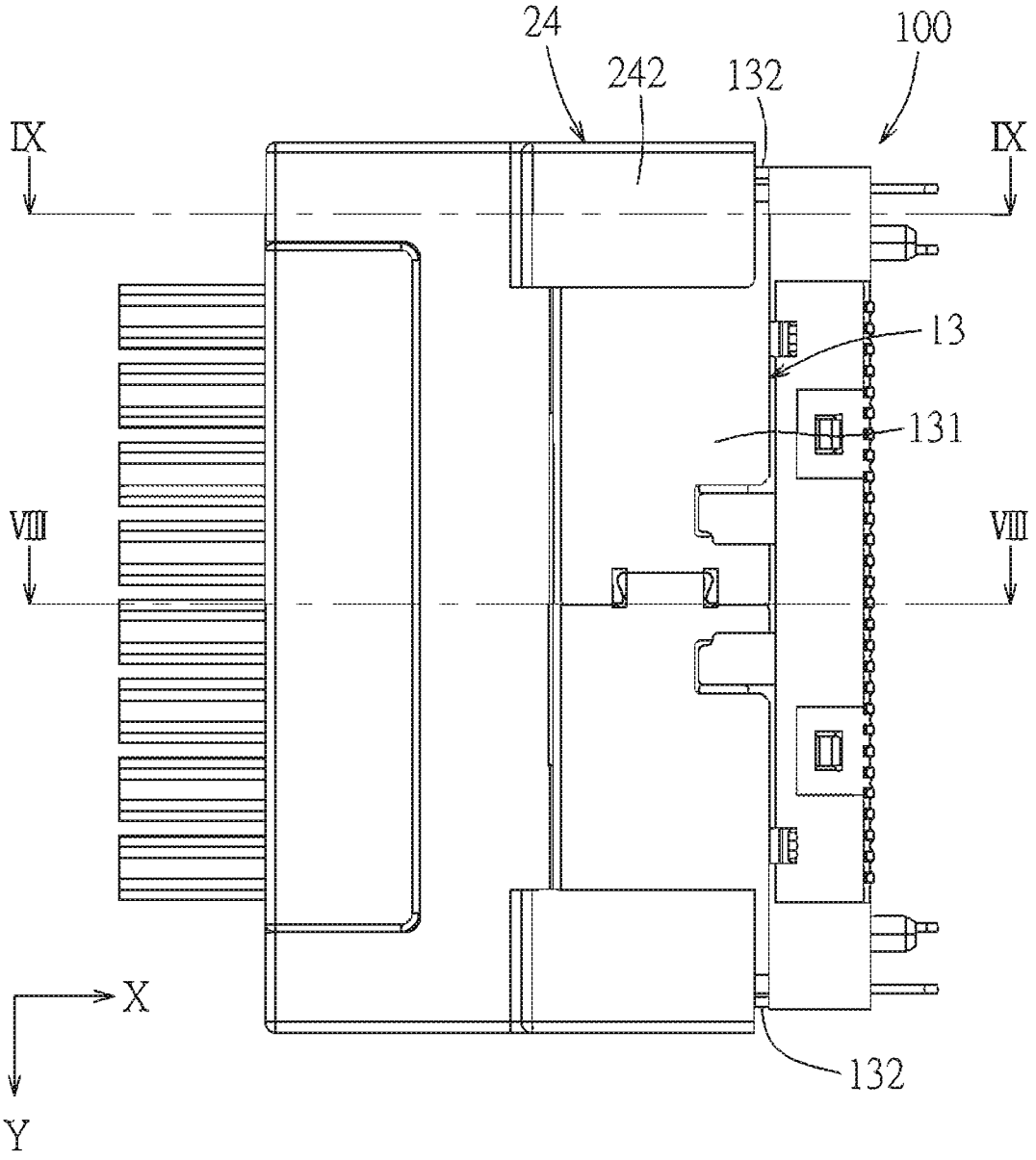
FIG. 7 is a bottom view of the first embodiment illustrating that the connector is properly inserted and mated with the mating connector.
Figure 8:
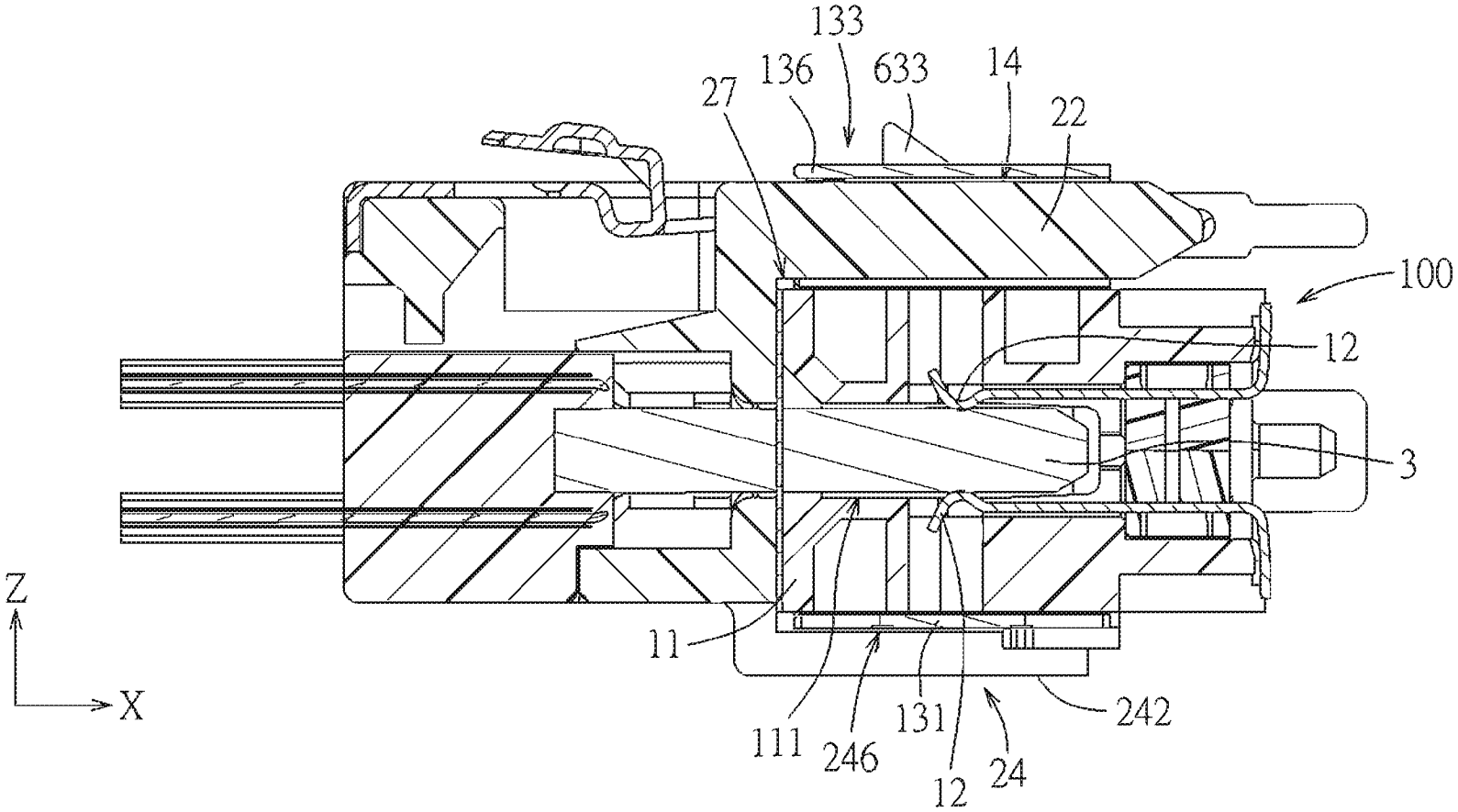
FIG. 8 is a cross-sectional view taken along a line VIII-VIII of FIG. 7.

Referring to FIG. 4, FIG. 6 and FIG. 8, when the connector 200 is to pulled out from the mating connector 100, the user can first grasp the grasping segment 72 of the pull strap 7 by a hand, subsequently, applies a force rearwardly along the front-rear direction X and pulls the grasping segment 72. During a process of pulling the grasping segment 72, the pressing plate 64 and the connecting rod 631 are pulled downwardly by the sheathing segment 71, so that each elastic arm 621 bends and deforms downwardly relative to the holding segment 61. Therefore, the two latching hooks 633 of each locking arm 632 will move downwardly into the positioning groove 25 and move away from the corresponding latching hole 138 to release the latching state between the two latching hooks 633 of each locking arm 632 and the metal shell 13.

It is noted that, the user can also directly press the pressing plate 64 by a hand to make the pressing plate 64 bring the locking segment 63 to move downwardly so as to release the latching state between the two latching hooks 633 of each locking arm 632 and the metal shell 13, so the present disclosure is not limited to the aforementioned manner performed by the pull strap 7.

Referring to FIG. 1 and FIG. 8, when the two latching hooks 633 of each locking arm 632 have moved away from the corresponding latching hole 138, the pull strap 7 can smoothly pull the insulative housing 2 rearwardly by means of the locking member 6. When the insertion plate 22 and the circuit board 3 has moved away from the receptacle 14 and the mating slot 111 respectively and the mating connector 100 has moved away from the two guide grooves 26, the receiving space 27 and the two limiting grooves 246, the connector 200 has been pulled out from the mating connector 100.

Figure 9:
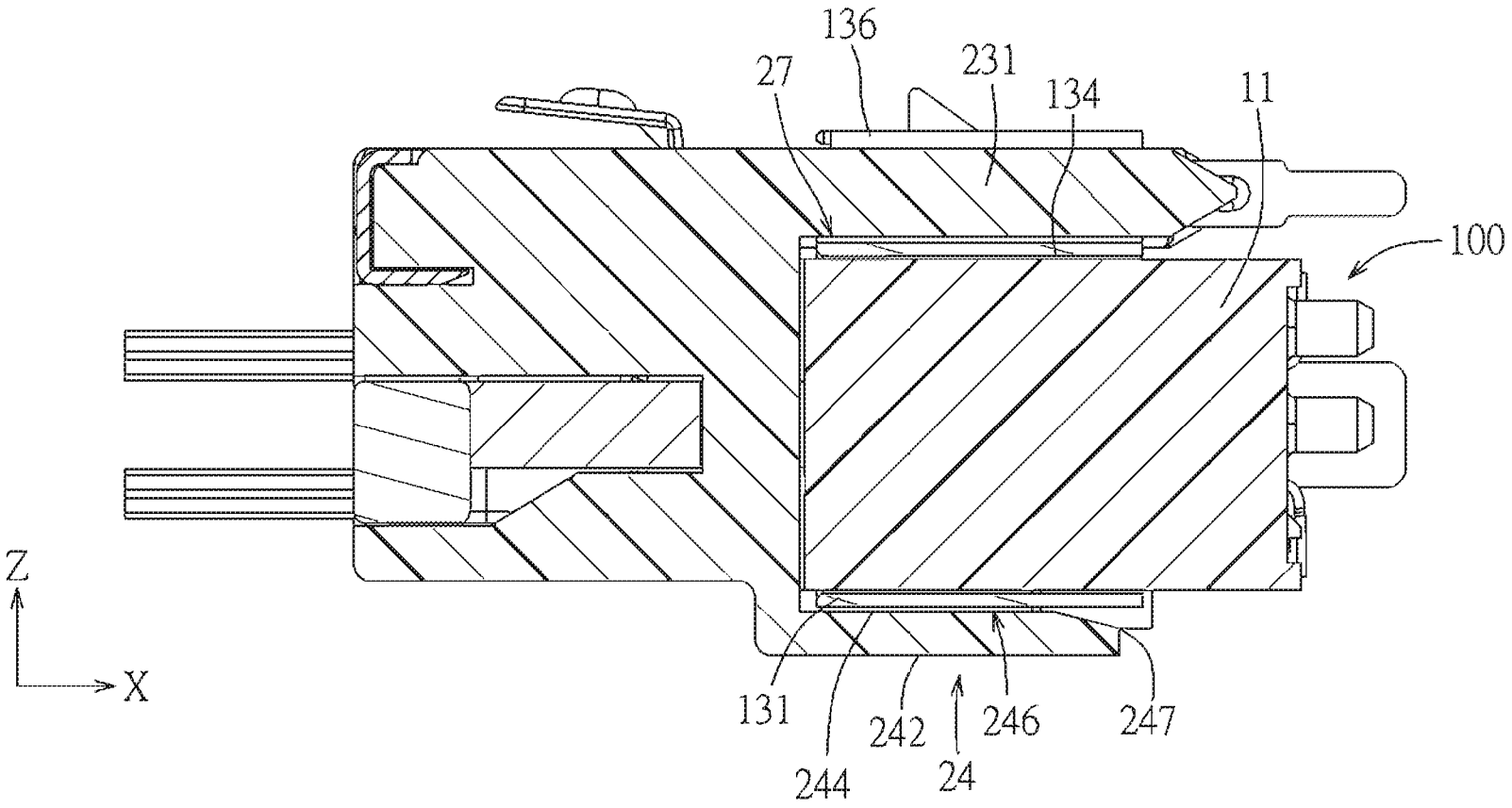
FIG. 9 is a cross-sectional view taken along a line IX-IX of FIG. 7 illustrating that a stopping wall portion is stopped to a bottom end of a bottom plate.

Referring to FIG. 1, FIG. 8 and FIG. 9, when the connector 200 is subjected to an external force along the up-down direction Z during the process of inserting or pulling out or after mated with the mating connector 100, because the bottom plate 131 of the metal shell 13 is received in the two limiting grooves 246 and is stopped by the inner stopping surfaces 244 of the stopping wall portions 242 and the insulative base 11 and the two connecting portions 134 are stopped by the insertion plate 22 and the top portions 231 of the two side walls 23 respectively, the connector 200 is equivalent to be firmly clamped in the mating connector 100 by means of the aforementioned structures. Therefore, a reaction force applied to the connector 200 by the mating connector 100 can be uniformly dispersed to the stopping wall portions 242, the insertion plate 22 and the top portions 231 of the two side walls 23, so that an amplitude of shaking of the connector 200 when the connector 200 is subjected to the external force can be effectively lowered. Therefore, a state that the connector 200 is stable and does not shake can be maintained during the process of inserting or pulling out, and the connector 200 cam be firmly fixed on the mating connector 100 after the connector 200 is mated with the mating connector 100.

Figure 10:
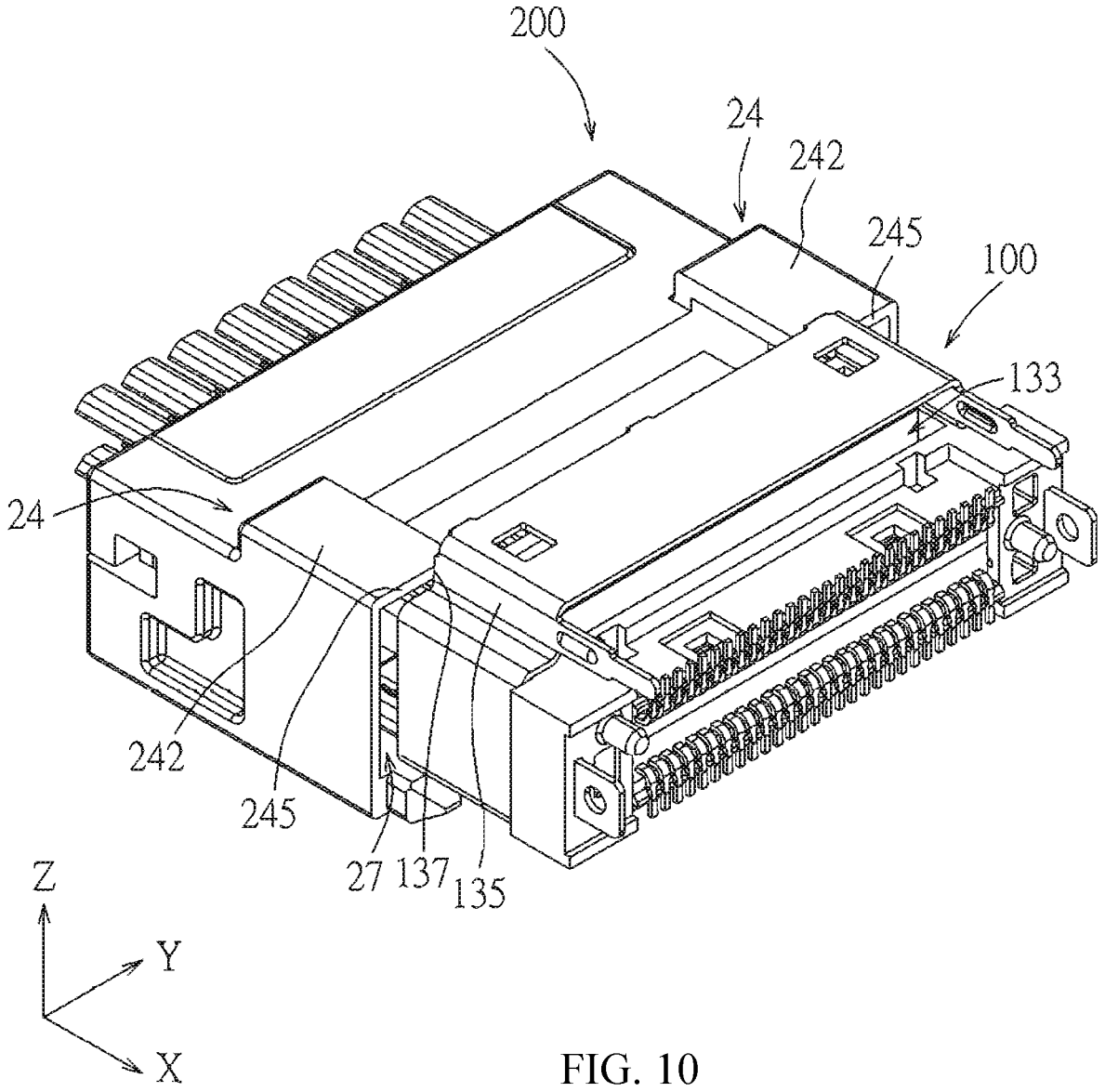
FIG. 10 is a perspective view of the first embodiment illustrating that the connector is inserted into the mating connector in an upside down orientation, and the two stopping wall portions are stopped to two side portions respectively.
Figure 11:
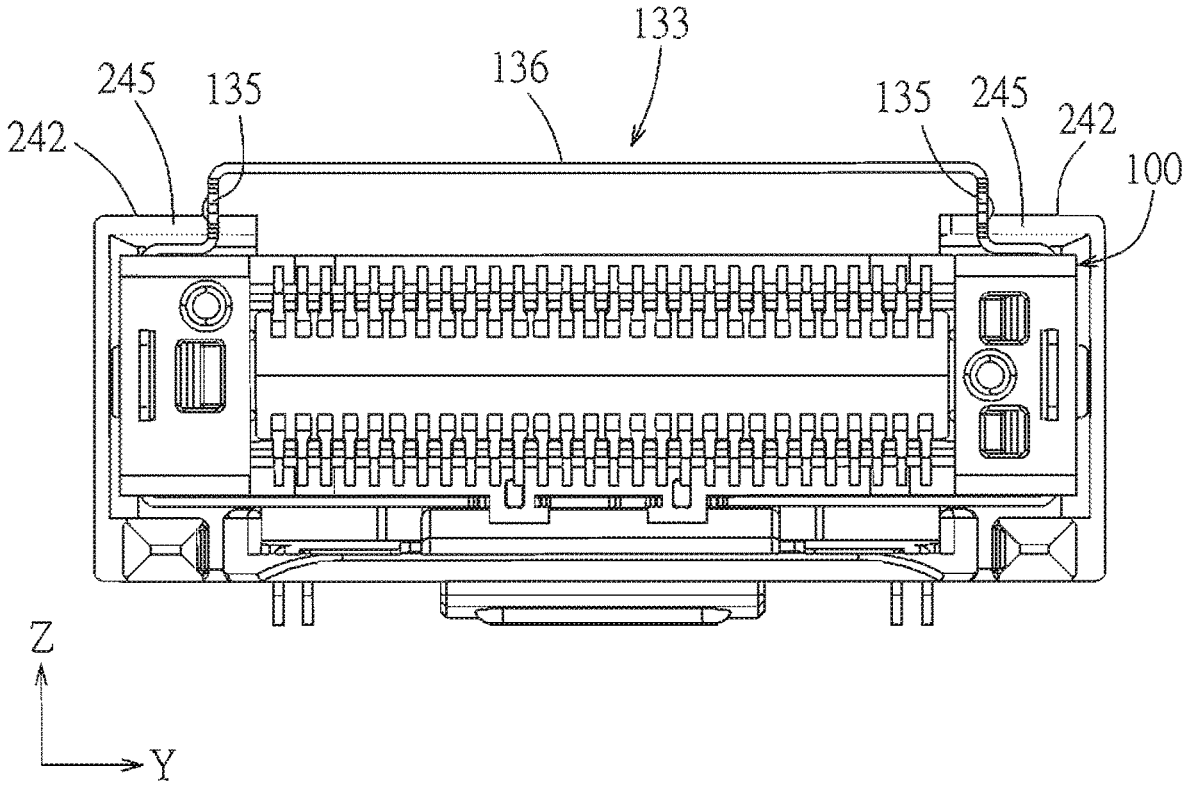
FIG. 11 is a front view of the first embodiment illustrating that the connector is inserted into the mating connector in the upside down orientation and the two stopping wall portions are stopped to the two side portions respectively.

Referring to FIG. 10 and FIG. 11, after the connector 200 is rotated by 180 degrees, the connector 200 moves forwardly in the front-rear direction X and is inserted into the mating connector 100, the stopping ends 245 of the two stopping wall portions 242 respectively contact and is stopped by the end edges 137 of the two side portions 135, so that the connector 200 cannot move forwardly to mate with the mating connector 100. Therefore, an effect of preventing the user from improperly inserting the connector 200 in an upside down orientation can be achieved.

Referring to FIG. 2, FIG. 9 and FIG. 10, in the first embodiment, in each stopping wall 24, the end wall portion 241 protrudes from the bottom surface 213 of the housing body 21 and is connected with the stopping wall portion 242, and the side wall portion 243 protrudes from the corresponding side wall 23 and is connected to a same side of the end wall portion 241 and the stopping wall portion 242, an overall structural strength of each stopping wall 24 can be increased, so that the stopping wall portion 242 is not easily deformed under the influence of an external force. Therefore, when the connector 200 is properly inserted into and mated with the mating connector 100, the stopping wall portion 242 of each stopping wall 24 can achieve an effect of stably supporting and stopping the bottom plate 131; when the connector 200 is improperly inserted into the mating connector 100 in an upside down orientation, the stopping wall portion 242 of each stopping wall 24 can achieve an effect of being firmly stopped by the end edge 137 of the corresponding side portion 135.

It is noted that the first embodiment may further have following other different implementation manners.

One implementation manner: each stopping wall 24 omits the side wall portion 243, so that each stopping wall 24 only has the end wall portion 241 and the stopping wall portion 242.

Another implementation manner: each stopping wall 24 omits the end wall portion 241, so that each stopping wall 24 only has the side wall portion 243 and the stopping wall portion 242.

Still another implementation manner: the stopping wall 24 is provided as one in number, the stopping wall portion 242 of the single stopping wall 24 supports and stops the bottom plate 131, or be stopped by the end edge 137 of the corresponding side portion 135. The aforementioned single stopping wall 24 can be the same as the stopping wall 24 of the first embodiment in specific structure, or may be one of the aforementioned two manners that one of the side wall portion 243 and the end wall portion 241 is omitted.

Figure 12:
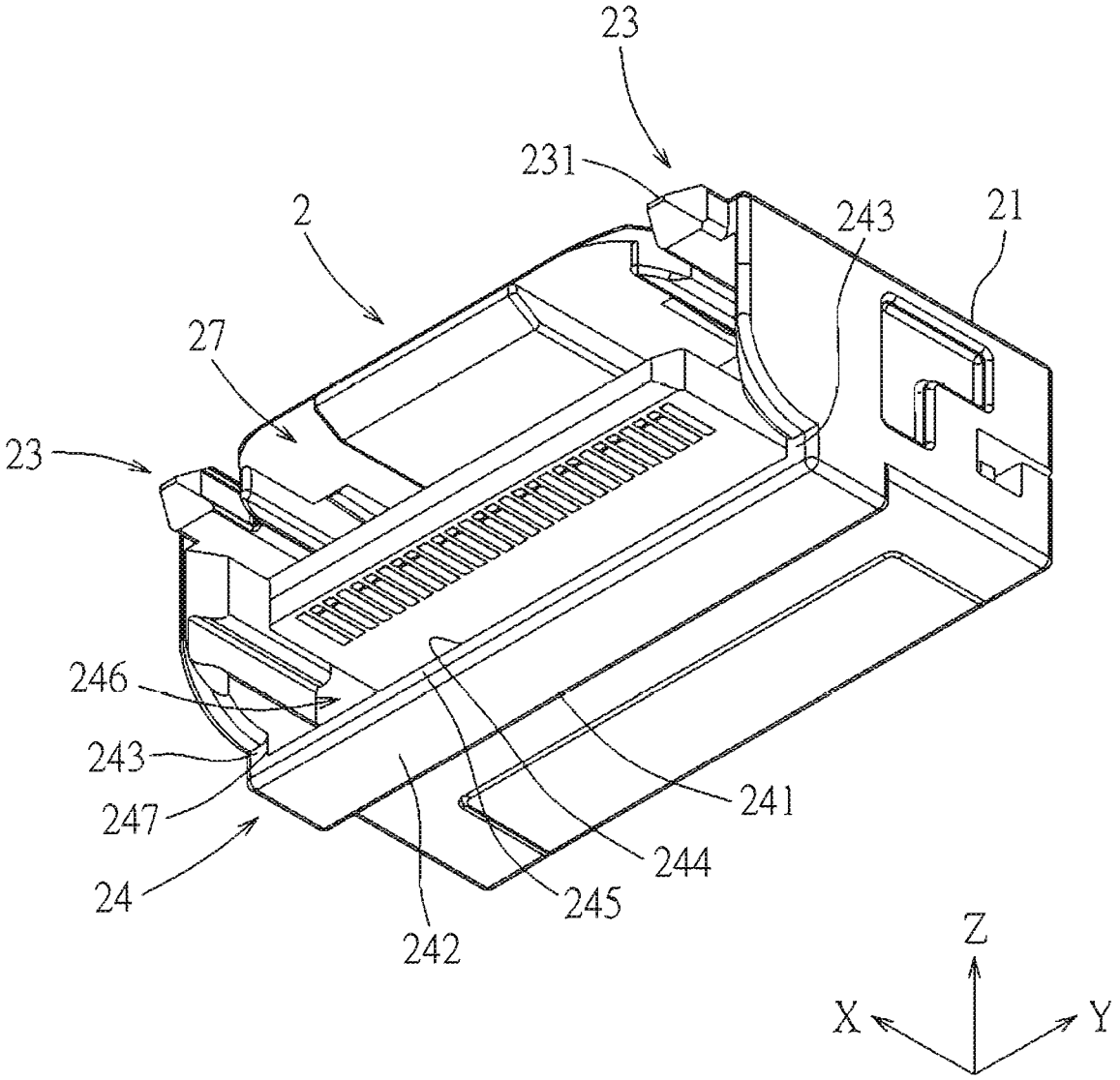
FIG. 12 is a perspective view of a connector of a second embodiment of the electrical connection device.

Referring to FIG. 12, an overall structure of a second embodiment of the electrical connection device of the present disclosure is substantively the same as that of the first embodiment, a difference lies in the stopping wall 24 of the connector 200.

In the second embodiment, the stopping wall 24 is provided as one in number, the stopping wall 24 has two side wall portions 243 which protrude downwardly from the bottom ends of the two side walls 23 respectively, the two side wall portions 243 are respectively connected to a left side and a right side of the end wall portion 241 and are respectively connected to a left side and a right side of the stopping wall portion 242, therefore, the overall structural strength of the stopping wall 24 can be further increased. The end wall portion 241, the stopping wall portion 242 and the two side wall portions 243 together define the limiting groove 246.

After the connector 200 is properly inserted and mated with the mating connector 100 as shown in FIG. 9, the inner stopping surface 244 of the stopping wall portion 242 can support and stop the bottom plate 131 with a larger area. Because the area of the inner stopping surface 244 is larger and the overall structural strength of the stopping wall 24 is increased, the stopping wall portion 242 can achieve an effect of supporting and stopping the bottom plate 131 more stably.

Figure 13:
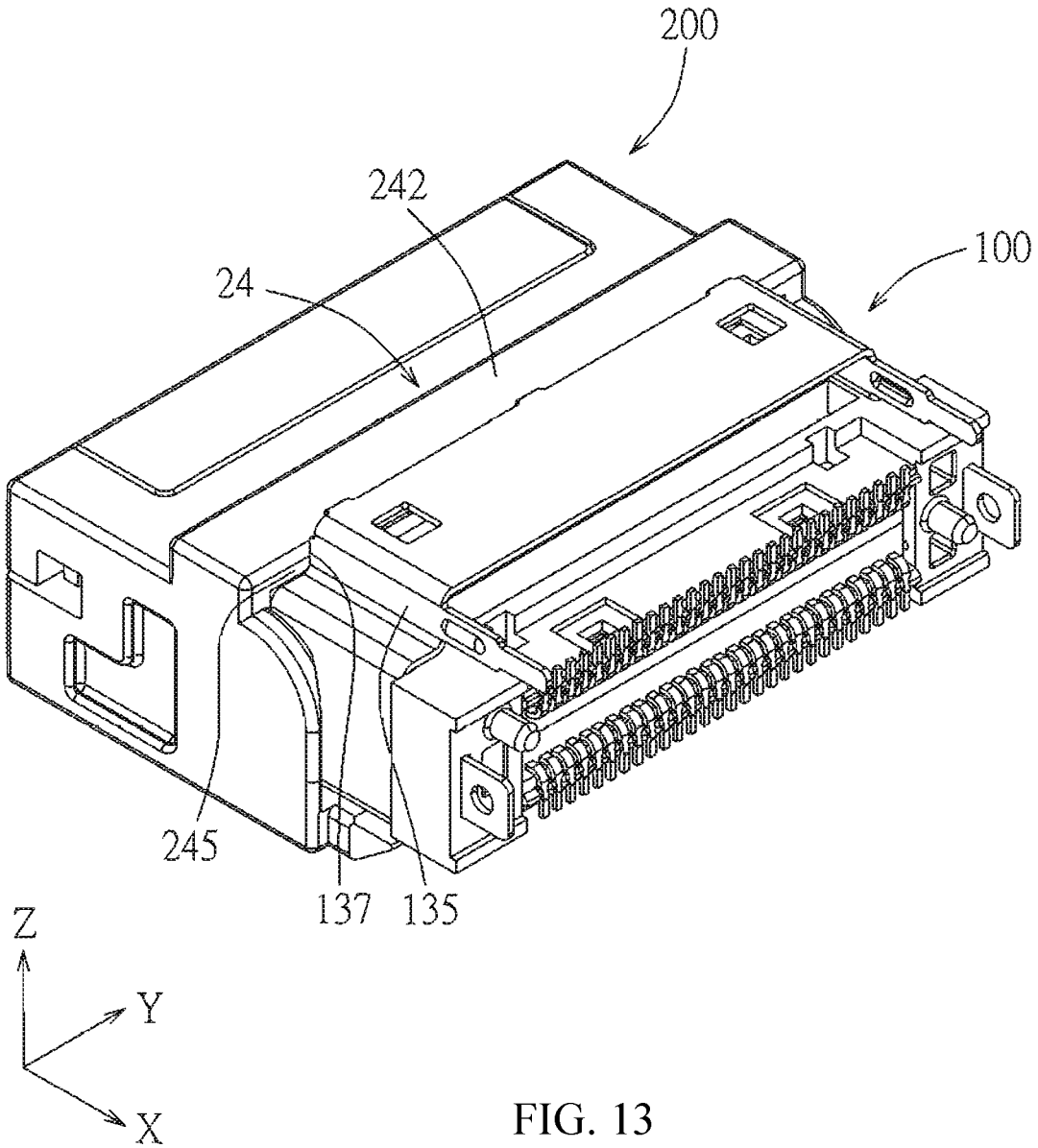
FIG. 13 is a perspective view of the second embodiment illustrating that the connector is inserted into the mating connector in an upside down orientation and the stopping wall portion is stopped to the two side portions at the same time.

Referring to FIG. 13, when the connector 200 is improperly inserted into the mating connector 100 in an upside down orientation, the stopping end 245 of the stopping wall portion 242 contacts and is stopped by the end edges 137 of the two side portions 135 at the same time. Because the overall structural strength of the stopping wall 24 is increased, the stopping wall portion 242 can achieve an effect of being stopped by the end edge 137 more firmly.

It is noted that the second embodiment may further have following other different implementation manners:

One implementation manner: the stopping wall 24 omits the two side wall portions 243, so that the stopping wall 24 only has the end wall portion 241 and the stopping wall portion 242.

Another implementation manner: the stopping wall 24 omits the end wall portion 241, so that the stopping wall 24 only has the two side wall portions 243 and the stopping wall portion 242.

In conclusion, in the connector 200 of each embodiment, the stopping wall portion 242 of the stopping wall 24 is stopped by the end edge 137 of the top plate 133 of the metal shell 13, it can prevent the user from improperly inserting the connector 200 in an upside down orientation into the mating connector 100. In addition, after the connector 200 is properly inserted and mated with the mating connector 100, the bottom plate 131 of the metal shell 13 is received in the limiting groove 246 and is stopped by the stopping wall portion 242 of the stopping wall 24, the connector 200 can be firmly mated with the mating connector 100, so that the object of the present disclosure can be indeed achieved.

However, the above description is only for the embodiments of the present disclosure, and it is not intended to limit the implementing scope of the present disclosure, and the simple equivalent changes and modifications made according to the claims and the contents of the specification are still included in the scope of the present disclosure.

What is claimed is:

1. A connector, comprising:

an insulative housing which comprises a housing body, an insertion plate, two side walls and at least one stopping wall, the housing body having a front end surface, the insertion plate being positioned at a top side of the housing body and protruding from the front end surface, the two side walls being respectively positioned at a left side and a right side of the housing body and protruding from the front end surface, the housing body, the insertion plate and the two side walls together forming a receiving space, and the stopping wall being positioned at a side of the insulating housing opposite to the insertion plate, the stopping wall having a stopping end positioned in front of the front end surface; and a circuit board which is provided to the housing body and partially protrudes into the receiving space, the circuit board protruding from the front end surface and being positioned between the stopping wall and the insertion plate.

2. The connector of claim 1, wherein the stopping wall defines a limiting groove which is communicated with the receiving space, and the limiting groove has an opening toward forwardly.

3. The connector of claim 1, wherein the stopping wall has a stopping wall portion which is connected with at least one of the housing body and one of the two side walls, and the stopping wall portion has the stopping end.

4. The connector of claim 3, wherein the stopping wall further has an end wall portion which protrudes from a bottom of the housing body, and the stopping wall portion protrudes from the end wall portion and is connected with the housing body via the end wall portion.

5. The connector of claim 3, wherein the stopping wall further has at least one side wall portion which protrudes from a bottom end of the corresponding side wall, and the stopping wall portion is connected to the corresponding side wall portion and connected with the housing body via the corresponding side wall portion.

6. The connector of claim 3, wherein the insulative housing comprises the two stopping walls which are spaced apart from each other in a left-right direction.

7. The connector of claim 1, wherein the connector further comprises a locking member which is provided to the insulative housing, and the locking member comprises a locking segment and a pressing plate extending upwardly from the locking segment.

8. An electrical connection device, comprising:

a mating connector, comprising:

an insulative base which is formed with a mating slot;

a plurality of terminals which are provided to the insulative base; and a metal shell which sheathes the insulative base and surrounds the insulative base, the metal shell comprising a top plate, and the top plate and the insulative base together defining an insertion groove; and a connector, comprising:

an insulative housing which comprises a housing body, an insertion plate, two side walls and at least one stopping wall, the housing body having a front end surface, the insertion plate being positioned at a top side of the housing body, protruding from the front end surface and being used to insert into the insertion groove, the two side walls being respectively positioned at a left side and a right side of the housing body and protruding from the front end surface, the housing body, the insertion plate and the two side walls together forming a receiving space which is used to allow the mating connector to insert, the stopping wall being positioned at a side of the insulative housing opposite to the insertion plate, the stopping wall having a stopping end which is positioned in front of the front end surface and is used to be stopped by an end edge of the top plate; and a circuit board which is provided to the housing body, partially protrudes into the receiving space and is used to mate with the mating slot, wherein:

when the connector is properly inserted, the insertion plate and the circuit board being capable of being inserted into the insertion groove and the mating slot of the mating connector respectively, so that the connector being mated with the mating connector; and when the connector is improperly inserted in an upside down orientation, the stopping wall being stopped by the end edge of the top plate to prevent the connector from being mated with the mating connector.

9. The electrical connection device of claim 8, wherein the metal shell further comprises a bottom plate opposite to the top plate, the stopping wall defines a limiting groove which is communicated with the receiving space and is used to receive the bottom plate, the limiting groove has an opening toward forwardly, and when the connector is properly inserted, the bottom plate is inserted into and received in the limiting groove via the opening.

10. The electrical connection device of claim 9, wherein a guiding groove is formed between each side wall and the insertion plate and is used to allow the corresponding side portion to insert, and when the connector is properly inserted, each side portion is inserted into the corresponding guiding groove.

11. The electrical connection device of claim 8, wherein the metal shell further comprises a bottom plate opposite to the top plate, the stopping wall protrudes from at least one of the housing body and the corresponding side wall and has an inner stopping surface, and when the connector is properly inserted, the inner stopping surface of the stopping wall stops a bottom end of the bottom plate.

12. The electrical connection device of claim 8, wherein the top plate has two side portions which are spaced apart from each other in a left-right direction, and when the connector is improperly inserted in the upside down orientation, the stopping end of the stopping wall is stopped by a side end edge of at least one of the two side portions.

13. The electrical connection device of claim 12, wherein the insulative housing comprises two stopping walls which are spaced apart from each other in the left-right direction, and the stopping end of each stopping wall is stopped by a side end edge of a corresponding side portion when the connector is improperly inserted in the upside down orientation.

14. The electrical connection device of claim 12, wherein the stopping end of the stopping wall is used to be stopped by side end edges of the two side portions at the same time.

15. The electrical connection device of claim 8, wherein the stopping wall has a stopping wall portion which is connected with at least one of the housing body and one of the two side walls, and the stopping wall portion has the stopping end.

16. The electrical connection device of claim 15, wherein the stopping wall further has at least one side wall portion which protrudes from a bottom end of the corresponding side wall, and the stopping wall portion is connected to the corresponding side wall portion and connected with the housing body via the corresponding side wall portion.

17. The electrical connection device of claim 15, wherein the stopping wall has two side wall portions which respectively protrude from the bottom ends of the two side walls, and the two side wall portions are respectively connected to a left side and a right side of the stopping wall portion.

18. The electrical connection device of claim 15, wherein the stopping wall further has an end wall portion which protrudes from a bottom of the housing body, and the stopping wall portion protrudes from the end wall portion and is connected with the housing body via the end wall portion.

19. The electrical connection device of claim 18, wherein the stopping wall further has two side wall portions which respectively protrude from bottom ends of the two side walls, and the two side wall portions are respectively connected to a left side and a right side of the end wall portion and are respectively connected to a left side and a right side of the stopping wall portion.

20. The electrical connection device of claim 8, wherein the connector further comprises a locking member which is provided to the insulative housing, the locking member comprises a locking segment which can be unlocked and locked to the metal shell and a pressing plate which extends upwardly from the locking segment, and when the connector is properly inserted, the locking segment is locked to the metal shell.

* * * * *